United States Patent [19]

Kisida et al.

[11] 4,310,118

[45] Jan. 12, 1982

[54] PACKAGING BAGS FOR POWDERY MATERIALS

[75] Inventors: Ichihei Kisida, Tokyo; Takashi Kobayashi, Akashi; Masahisa Matsushita, Omiya, all of Japan

[73] Assignee: C. I. Kasei Co. Ltd., Tokyo, Japan

[21] Appl. No.: 109,251

[22] Filed: Jan. 3, 1980

[30] Foreign Application Priority Data

Aug. 10, 1979 [JP] Japan ..... 54-109513[U]

[51] Int. Cl.[3] ..... B65D 30/24

[52] U.S. Cl. ..... 229/62.5; 229/DIG. 14

[58] Field of Search ..... 229/62.5, DIG. 14; 137/845; 426/118, 130, 395; 150/9; 220/371

[56] References Cited

U.S. PATENT DOCUMENTS 3,092,249 6/1963 Chapman ..... 229/DIG. 14

FOREIGN PATENT DOCUMENTS 1169280 11/1969 United Kingdom ..... 229/DIG. 14

*Primary Examiner*—George T. Hall

*Attorney, Agent, or Firm*—Brisebois & Kruger

[57] ABSTRACT

The invention provides a packaging bag for powdery or granular materials made of a plastic film having no air permeability, which is safe from the accident of bursting even when the bag filled with a powdery or granular material is laid at or near the bottom of a heap of such bags caused by the weight of the overlying bags. The inventive bag is provided with an air filter member bonded to the body of the bag in such a manner that the air inside the bag is communicated with the ambient atmosphere through the air filter member which is, for example, an open-cell foamed body of a plastic material.

7 Claims, 6 Drawing Figures

PACKAGING BAGS FOR POWDERY MATERIALS

BACKGROUND OF THE INVENTION

The present invention relates to a packaging bag for powdery or granular materials or, more particularly, to a packaging bag which is safe from the danger of bursting by the internal air pressure caused when a great number of the bags filled with a powdery or granular material are stacked one on the other to a considerable height as in storehouses.

It may be too much to say that a variety of powdery or granular materials are transported, stored and sold as packaged in packaging bags of a suitable size with convenience in handling. Such powdery or granular materials include foodstuffs, e.g. cereal grans, flours, sugar and the like, fillers and other additives used in the processing of rubbers and plastics, e.g. carbon blacks, man-made fertilizers, Portland cement and others.

It is a growing recent trend in the materials for the bags that packaging bags made of a film or sheet of a synthetic plastic resin are used in place of traditional paper bags made, for example, of kraft paper.

Plastic bags for packaging have their own advantages in their beautiful appearance, high mechanical strengths, excellent moisture-proof property and other respects. Plastic bags are moisture-proof owing to the water resistance of the synthetic plastic resin per se and the low permeability of air and atmospheric moisture through the films or sheets of the plastic resins.

It is recently proposed and practiced that fillers and other additive materials used in the processing of rubbers and plastics are packaged in bags made of films of a rubber or plastic resin having compatibility with and not adversely influencing the properties of the rubber or plastic resin to which the additive material is blended so that the filler or additive contained in the bags can be introduced as such into the blending machine in which the rubber or plastic resin is under milling without opening the packaging bags. Such a way of handling is particularly advantageous when the powdery material in the bags has a noxious nature such as carbon black which may cause serious contamination of environment even with a very small amount scattered in handling because, although carbon blacks are usually formed in beads or granules, considerable amount of finely divided powdery carbon is always contained in the bag due to the pulverization of the granules or beads during transportaion and handling.

Contrary to the great advantages described above, packaging bags made of a plastic or a rubber film or sheet have a very serious defect not encountered in paper bags having good air permeability. This defect is especially apparent when a great number of the bags filled with, for example, carbon black, are stacked one on the other to a heap as is frequently seen in storehouses. In such a circumstance, the bags lying at or near the bottom of the heap receive a tremendous pressure by the weight of the bags lying upon them. Therefore, the air remaining in the bags is heavily compressed to a considerably high pressure so that the bags become very likely burst causing a heavy contamination of the environment by the powder, e.g. carbon black, ejected from the broken bags.

Furthermore, when a bag containing carbon black or other additives is charged without being opened into a Banbury mixer, mixing roller mill or other blending machine with a large volume of air remaining after the bag has been sealed by welding or other hermetical means, the bag becomes burst in the blending machine also to cause environmental contamination by the carbon black ejected from the broken bag.

To overcome the above described difficulties, an attempt is practiced in bags for man-made fertilizers in which the bags are provided with a number of tinly holes at a suitable portion thereof so that the air in the bag can escape through the holes when the bag receives an external compression. This method is, however, not applicable to the bags for carbon blacks or other very fine powdery materials since the particles of the powdery material may be ejected or escape through the holes to cause environmental contamination.

SUMMARY OF THE INVENTION

Thus, an object of the present invention is to provide a novel bag for packaging a powdery or granular material made of a film or sheet of a material having substantially no air permeability such as a plastic or rubber free from the above described problem of bursting even when the bag containing a powdery or granular material and hermetically sealed receives a large pressure from outside so as otherwise to cause a pressure increase of the air remaining in the sealed bag leading to the burst of the bag.

The bag of the invention for packaging a powdery or granular material made of a film or sheet having substantially no air permeability comprises at least one air filter member bonded to the film or sheet of the bag in such a manner that the air inside the bag is in communication with the ambient atmosphere through the air filter member.

BRIEF DESCRIPTIOON OF THE DRAWING

DETAILED DESCRIPTION OF THE PREFERRED EMBODIMENTS

Figure 1:
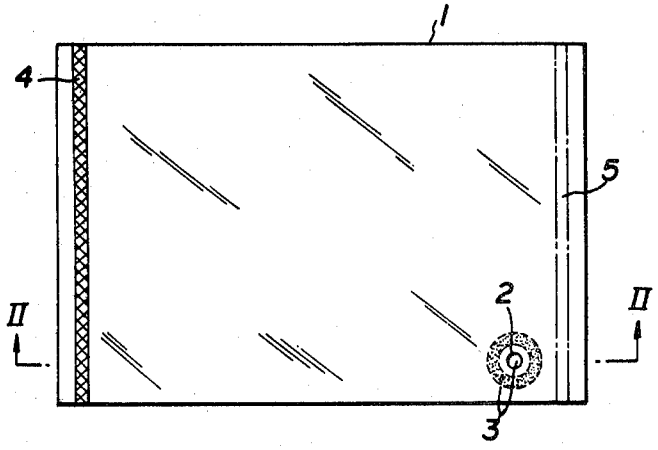
FIG. 1 is a plan view of the inventive bag before filling with a powdery or granular material.

Detailed description of the inventive bags is now given with reference to the drawing annexed illustrating the invention by way of examples but not limiting the scope of the invention.

In FIG. 1 showing the plan view of a bag of the invention laid flat without being filled with a powdery or granular material with its mouth unsealed, the body of the bag 1 is made of a film or sheet having substantially no air permeability such as a plastic or rubber film. The material of such a film or sheet is not limitative and any conventional material may be used including polyethylene, polypropylene, ethylene-vinyl acetate copolymer resins, polyvinyl chloride, 1,2-polybutadiene and chlorinated polyethylene as well as various kinds of synthetic rubbers. It is of course optional that a polymer blend of two kinds or more of the above named polymeric substances with optional admixture of a filler, lubricant and other conventional additives can be used.

The thickness of the film or sheet is also not limitative provided a flexibility as a film or sheet is not unduly reduced to cause an inconvenience in handling. A laminated film or sheet is also used.

The body 1 of the bag is sealed along its bottom line 4 by welding or other suitable means capable of ensuring hermetical sealing of the bag to form the bag bottom.

Figure 3:
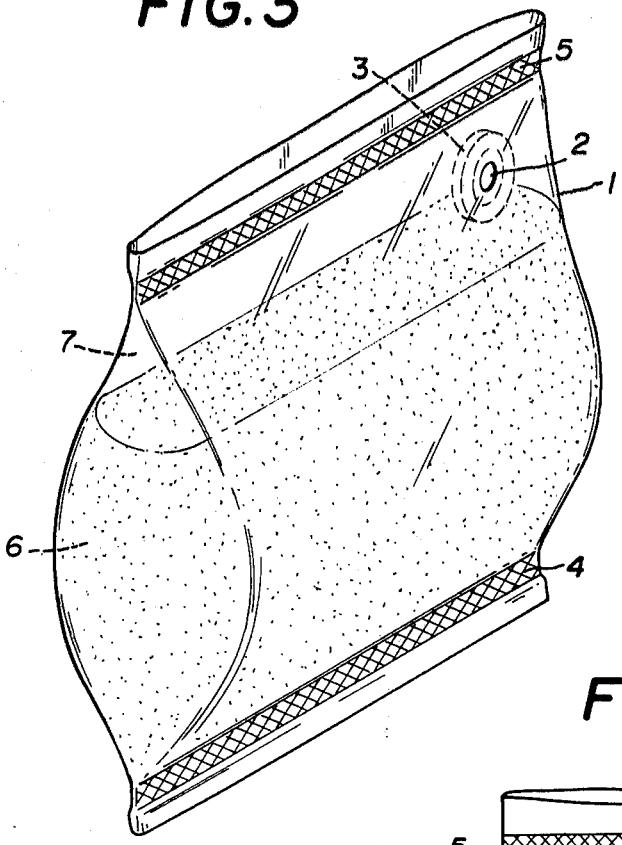
FIG. 3 is a perspective view of the bag of FIG. 1 filled with a powdery material and sealed along the upper seal lines.

The chained lines 5 along the right-hand end of the bag 1 in FIG. 1 are imaginary seal lines along which the bag is sealed hermetically by welding or other suitable means after the bag is filled with a powdery or granular material as is shown in FIG. 3 illustrating a perspective view of the bag filled with the powdery or granular material 6 and sealed along the upper seal lines 5.

Figure 2:
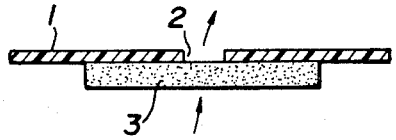
FIG. 2 is a partial cross sectional view of the inventive bag taken along the line II—II in FIG. 1.

The body of the bag 1 is provided with a circular opening 2 near the upper seal lines 5 as is shown in FIG. 1 and in FIG. 2 which illustrates a cross sectional view taken along the line II—II in FIG. 1. Covering the opening 2 in the body 1 of the bag, an air filter member 3 is attached to the bag from inside of the opening, preferably, by use of an adhesive agent or by welding so as that the air inside the bag is communicated with the ambient atmosphere even when the bag is hermetically sealed along the seal lines 5 after the bag is filled with a powdery or granular material as is shown in FIG. 3. Accordingly, the air inside the bag is always under an equilibrated pressure with the atmospheric air and there is no danger of bursting of the bag even when the bag is lying at or near the bottom of a heap as in a storehouse or is thrown into a blending machine as containing the powdery or granular material.

The size of the opening 2 and the porosity of the air filter member 3 should be determined so as that a pressure equilibration between the air inside the bag and the atmospheric air can be rapidly established even when the bag undergoes a sudden compression. The porosity of the air filter member is desirably as coarse as possible in order to ensure a rapid pressure equilibration although, of course, the air filter member must be sufficiently dense and thick to be capable of preventing escape of any small amounts of the powdery material contained in the bag.

The material of the air filter member 3 is not limitative but it is, preferably, a sintered body made of a powder of the same plastic material as that of the body 1 of the bag or it may be an open-cell foamed body expanded with a foaming agent admixed in the plastic material. The plastic material can be either cured or uncured. It is also optional to use an air filter member 3 made of a woven or non-woven fabric of a fibrous material instead of the spongy sintered or foamed body as mentioned above. At any rate, it is desirable that the filter member 3 has a sufficient flexibility as in flexible polyurethane foams to be safe from being broken or crushed by the destructive forces during handling of the bag.

The position of the opening 2 is not limited to that shown in the figures although it is not recommended that the opening 2 is positioned at the middle portion of the body 1 of the bag since, when numbers of such bags are stacked to a heap laying one on the other, the opening 2 covered with the air filter member 3 is necessarily in contact with the floor or with the body of another bag so that the communication of the air inside the bag with the ambient atmosphere is not obtained. It is of course optional that a bag is provided with two or more of the openings 2 each covered with an air filter member 3.

The manner in which the inventive bag is used for packaging a powdery or granular material, e.g. carbon black, is conventional and need not be explained in detail. As is shown in FIG. 3, the powdery or granular material 6 is put into the bag from the open mouth and the bag is sealed by welding along the seal lines 5 leaving certain volume of air in the air space 7 inside the bag. The thus sealed bags are stored or transported as in the handling of conventional bags.

When the bags filled with a powdery or granular material, e.g. carbon black, and sealed are stacked on each other to a heap, the underlying bags receive an external pressure by the overlying bags and the air in the bag escapes out of the bag through the micropores in the air filter member 3 so that the external pressure is directly transmitted to the powdery or granular material contained in the bag and the bags can settle better in the heap without the danger of bursting of the bags or disintegration of the heap. The fine powder of the carbon black is never ejected as accompanied by the air escaping through the air filter member 3 since any finest particles can be trapped in the micropores of the air filter member 3 so as that contamination of the environment can be prevented.

When the inventive bags are used for packaging an additive to be used in the formulation of a synthetic resin or a rubber, e.g. carbon black, it is advantageous that not only the material for the body 1 of the bag but also the material for the air filter member 3 are compatible with the synthetic resin or rubber under processing and exert no adverse influences on the properties of the finished resin or rubber products such as 1,2-polybutadiene polymer so as that removal of the air filter member 3 is not necessary prior to the introduction of the carbon black into the rubber composition under milling as contained in the bag. Further, an air filter member 3 made from 1,2-polybutadiene is recommended owing to the easiness in bonding the air filter member 3 to cover the opening 2 of the body 1 of the bag with its low melting point of 75° to 110° C. facilitating welding of the air filter member 3 to the body 1 of the bag with an iron, heat sealer, impulse sealer and the like.

Although the above description is given mainly for the bags used for packaging additive materials in resin or rubber processing, the application of the inventive bags is not limited thereto but the bags can be used for packaging any other powdery or graular materials.

It is noted that many of variations are possible in the manner in which the air filter member 3 is bonded to the body 1 of the bag to cover the opening 2. First, the opening 2 is not limited to circular one but may be of any forms including rectangles, squares, longitudinally or transversely extending slots, a number of perforations and the like. Further, the air filter member 3 may be bonded to the outer surface of the body 1 of the bag instead of inner surface as is shown in FIGS. 1 to 3.

Figure 4:
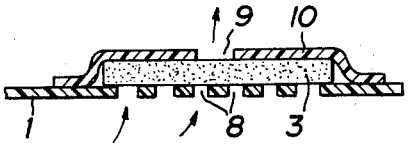
FIG. 4 is a partial cross sectional view of another type of the inventive bag with perforations in the body of the bag.

FIG. 4 is a cross sectional view of the air filter member 3 attached to the outer surface of the body 1 of the bag, in which the air filter member 1 is placed on the outer surface of the body 1 of the bag to cover the perforations 8 and pressed against the surface by the annular patch 10 having an opening 9. In this case, it is not always necessary to adhesively bond the air filter member 3 to the outer surface of the body 1 of the bag since contacting of the air filter member 3 and the surface of the body 1 of the bag is ensured by the patch 10 and the air inside the bag is communicated with the ambient atmosphere through the perforations 8, air filter member 3 and the opening 9 in the patch 10.

Figure 5:
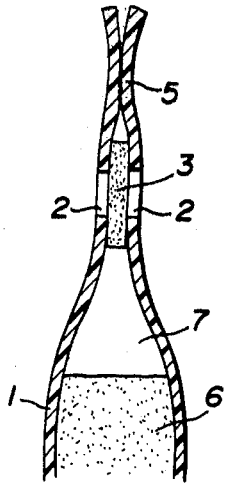
FIG. 5 is a partial cross sectional view showing a further different manner for bonding the air filter member to the body of the bag.

FIG. 5 illustrates another embodiment of the invention in which the air filter member 3 is bonded on both sides to the body 1 of the bag so that the body 1 of the bag is constricted at the air filter member 3.

Figure 6:
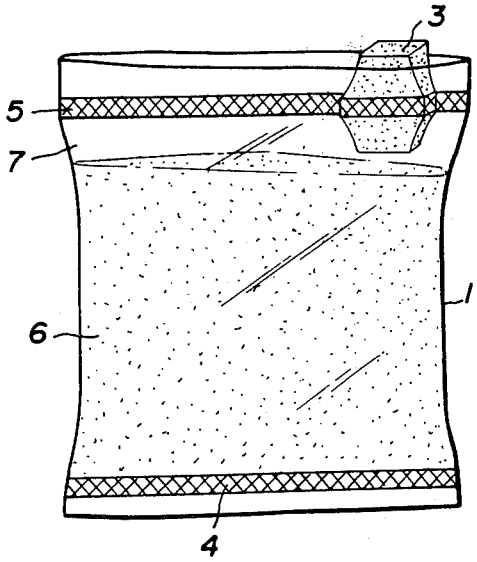
FIG. 6 is a perspective view of the bag in which the air filter member is inserted to the mouth of the bag something like a plug.

FIG. 6 shows a further embodiment of the invention in which the air filter member 3 in a form of a block is sandwiched between the seal line portions 5 with its upper end appearing in the open mouth of the bag. In this embodiment, the air filter member 3 may be bonded beforehand to the body of the bag 1 or may be inserted to the mouth of the bag something like a plug after the bag is filled with the powdery or granular material 6 with subsequent bonding to the body 1. It is sometimes advisable for enhancing the filter effect that the micropores on the side surface of the air filter member 3 are destroyed so that the air inside the bag is communicated with the ambient through the end surfaces alone of the air filter member 3.

What is claimed is:

1. A packaging bag for powdery or granular materials made of a film or sheet having substantially no air permeability and comprising, generally flat side walls sealed along at least three sides of the bag, a filling opening along an end of the bag, one of said side walls having at least one aperture of a size smaller than the filling opening, and an air filter element within the bag, said filter element comprising a porous pad covering said aperture and directly bonded to the side wall around said aperture, said pad presenting an uncovered face within the bag, and said filter permitting the escape of air from the bag upon compression thereof after filling the bag and sealing the filling opening.

2. The packaging bag as claimed in claim 1 wherein the air filter member is made of a foamed body of a synthetic resin with open cells.

3. The packaging bag as claimed in claim 1 wherein the body of the bag has a number of perforations and the air filter member is bonded to the body of the bag to cover said perforations.

4. A packaging bag according to claim 1 wherein said porous pad comprises, a sintered pad made of a powder of a plastic material.

5. A packaging bag according to claim 4 wherein said bag comprises a bag of plastic material, and said porous pad comprises a plastic material which is the same as the plastic material of the bag.

6. A packaging bag according to claim 1 wherein said porous pad comprises a woven fabric of fibrous material.

7. A packaging bag according to claim 1 wherein said porous pad comprises a non-woven fabric of fibrous material.

* * * * *